United States Patent [19]

Soffge et al.

[11] 3,964,119

[45] June 22, 1976

[54] SUPPORT LEG FOR BRIDGES

[75] Inventors: Friedhelm Soffge, Kornwestheim; Gerhard Albrecht, Illingen, both of Germany

[73] Assignee: Dr. -Ing. H.c.F. Porsche Aktiengesellschaft, Germany

[22] Filed: May 12, 1975

[21] Appl. No.: 576,443

[30] Foreign Application Priority Data

May 11, 1974 Germany ..... 2422895

[52] U.S. Cl. ..... 14/75; 61/46.5; 254/110; 254/93 R

[51] Int. Cl.[2] ..... E01D 19/02

[58] Field of Search ..... 14/75; 61/46.5; 254/110, 93 R

[56] References Cited

UNITED STATES PATENTS

| | | | |
|---|---|---|---|
| 2,954,676 | 10/1960 | Guy | 61/46.5 |
| 2,967,400 | 1/1961 | Grant | 61/46.5 |
| 2,997,852 | 8/1961 | Suderow | 61/46.5 |
| 3,171,259 | 3/1965 | Roussez | 61/46.5 |
| 3,290,007 | 12/1966 | Yeilding | 254/106 |
| 3,347,522 | 10/1967 | Reinmann | 254/105 |
| 3,435,621 | 4/1969 | Johnson | 61/46.5 |
| 3,577,737 | 5/1971 | Burleson | 61/46.5 |
| 3,763,654 | 10/1973 | Matsushita | 254/105 X |
| 3,845,514 | 11/1974 | Wagner | 14/1 |

*Primary Examiner*—Nile C. Byers
*Attorney, Agent, or Firm*—Craig & Antonelli

[57] ABSTRACT

Support leg construction for tank portable bridges including a housing or support leg formed by respective inner and outer sleeve members. A longitudinally movable stanchion is guided intermediate the inner and outer sleeves. A hydraulically operable piston member is disposed in the inner sleeve and includes hydraulically operable detent spring ring locking means for selectively locking the piston to the stanchion. A further hydraulically operable spring-ring locking mechanism is fixedly disposed at the open end of the inner sleeve for selectively locking the stanchion in position with respect to the inner and outer sleeves.

18 Claims, 3 Drawing Figures

SUPPORT LEG FOR BRIDGES

BACKGROUND AND SUMMARY OF THE INVENTION

The present invention relates to a support leg for bridges, especially for portable bridges of the type transportable by military tanks and the like. Such support legs include a stancion movable in the longitudinal direction of the leg for retraction and extension, as well as means for locking the stanchion in prdetermined length positions.

In German Offenlegungsschrift 1,927,870, there is disclosed a mechanical, adjustably extensible support leg which can be anchored in different positions at an inner stanchion. For anchoring of the extension two collars (clamps) are provided rotatable about a common hinge bolt, which collars have semicircular shape and are each provided with a handle at the outer side thereof and provided at the inner side thereof with legs and projections to engage in grooves in the extension of the inner stanchion. This mechanical device is costly and cannot be housed inside of the support leg as a result of the required manual operation since the collar must be swung open by a considerable amount to accommodate adjustment of the extension.

The present invention contemplates providing apparatus which overcomes the above-noted disadvantages of the device described in said German Offenlegungsschrift. The present invention contemplates providing a support leg of the type mentioned above which has a stanchion which may be retracted and extended in various lengths and which can be locked in any position at the leg. Further, the support leg according to the present invention can be constructed such that it requires a minimum number of repair and maintenance structural parts.

In accordance with preferred embodiments of the present invention, the stanchion is adjusted longitudinally in the support leg by means of a hydraulic, axially movable piston member, which piston member is provided with an adjusting device for selectively locking the piston member to the stanchion. The present invention further contemplates providing the support leg or housing with a longitudinally stationary arranged locking device which is hydraulically controllable to be brought into and out of engagement with stops arranged in the walls of the stanchion.

According to another feature of the invention, the stanchion is movably guided between an inner and outer sleeve of the leg and is in operational contact with the piston member which is guided in the inner sleeve and carries the adjusting or locking device for locking the piston member to the stanchion. According to preferred embodiments of the invention, the piston member is provided at the free end thereof opposite the pressure medium surface with the adjusting device which includes radially adjustable spring rings and hydraulic piston-cylinder means for adjusting the spring rings. The preferred embodiment of the invention also contemplates that the locking device which is stationary with respect to the housing or support leg is provided at the free end of the inner sleeve (open end which accommodates extension and retraction of the stanchion), which locking device likewise carries hydraulically adjustable spring rings.

In the preferred embodiment of the invention, the stanchion is formed as a tube provided at the inner walls thereof with a plurality of ring grooves spaced longitudinally with respect to one another and in alignment, which ring grooves are constructed as stops selectively engageable by the spring rings discussed in the preceding paragraph.

According to preferred embodiments of the invention, the spring rings are constructed as slotted rings having free ends in facing spaced relationship to one another, with fluid pressure responsive piston-cylinder means interposed between the respective free ends of the spring rings so as to accommodate pressing of the spring rings into the ring grooves and retraction thereof.

A hydraulically operable support leg constructed according to the present invention results in advantages over previously known support legs in that the locking and positioning are of simple construction, are provided inside the outer walls of the support leg, and are easily exchangeable. The protected arrangement of the devices for extending the support leg as well as the locking and adjustment of the stanchion with respect to the support leg is significant especially in portable bridge constructions where failure of a support leg caused by external influences would be quite detrimental. By means of the hydraulic controlability the stanchion may be positioned in any position in a simple way through extending, respectively retracting, to any length in dependence on the stopping capabilities at the inner wall of the stanchion (the number and spacing of ring grooves).

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
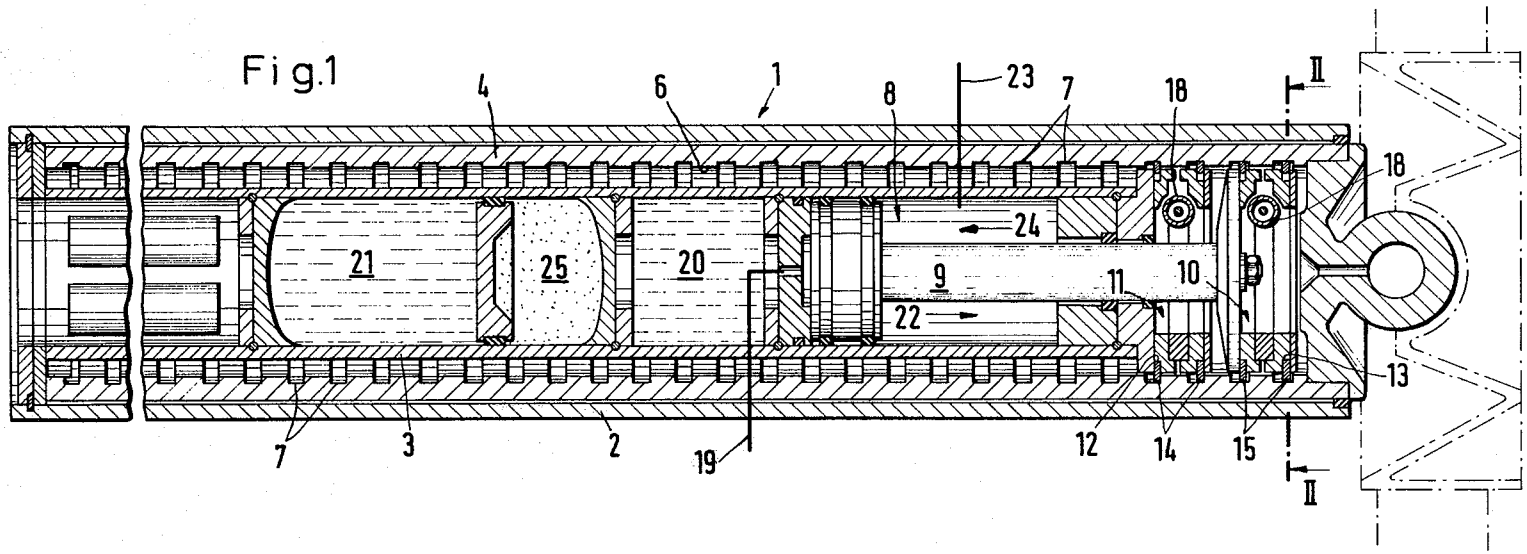
FIG. 1 is a sectional-schematic view of a support leg constructed in accordance with the present invention.

In the following description, like reference numerals are used to designate like parts in the various views. The support leg 1 includes an outer sleeve 2 and an inner sleeve 3 which are connected with each other to form a support leg housing. Tubular shaped stanchion 4 is guided between these sleeves 2 and 3. A support foot is shown in dot-dash lines at the righthand end of the stanchion 4, which support foot is carried by and movable with the stanchion 4. In the inner wall 6 of the tube shape stanchion 4, a number of ring grooves 7 are provided, which ring grooves serve as stops as will be described in more detail below.

A piston 8 is slidably guided in the inner sleeve 3. This piston 8 carries an adjusting or locking device 10 at the piston rod extending from the free end of the piston opposite the fluid pressure spaces. A further adjusting or locking device 11 is provided at the free end of the inner sleeve 3, which locking device 11 is fixed in axial position with respect to the sleeve 3.

Figure 3:
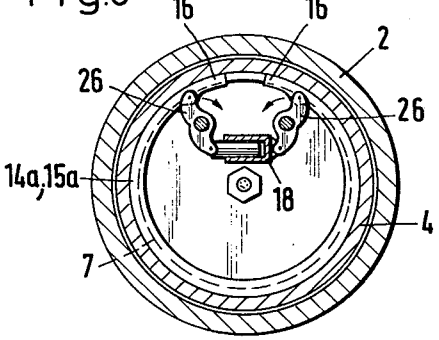
FIG. 3 is a view similar to FIG. 2 which shows a further exemplified embodiment of the adjusting means for the spring rings.
Figure 2:
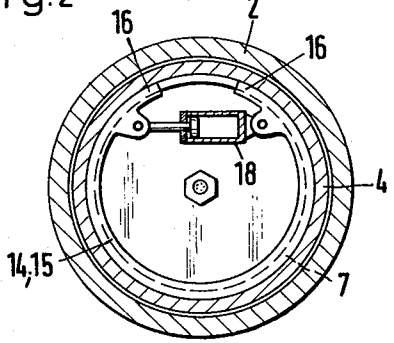
FIG. 2 is a sectional view along line II—II of FIG. 1.

The adjusting device 10 as well as the locking device 11 include respective spring rings 14, 14*a;* 15, 15*a* resting in respective ring grooves 12, 13. As best shown in FIGS. 2 and 3, hydraulically operable piston-cylinder arrangements 18 are interposed between the free ends of the split spring rings, which arrangement 18 is capable of pulling the ends of the spring rings together so that the spring rings are radially compressed into the respective ring grooves 12 and 13. The piston-cylinder arrangement 18 is also capable of pressing the spring rings outwardly into the ring grooves 7 of the stanchion 4 so as to lock the piston 8 for movement with the stanchion 4.

In the modified embodiment of the invention depicted in FIG. 3, the piston-cylinder arrangement 18 acts through a two-armed lever 26 on the free ends 16 of the spring rings 15*a* (14*a*). By this means, the spring means may be additionally closed so that the piston in the hydraulic cylinder for unlocking requires the execution of only a small stroke.

The spring rings are arranged respectively longitudinally spaced from one another and are provided in the control device 10 as well as in the locking device 11. The number of spring rings to be used is determined by the forces to be absorbed, with the preferred embodiment showing a pair of spring rings for each of the control device 10 and locking device 11.

In the illustrated preferred embodiment, the spring rings are circular in shape and formed with a single open slot intermediate the free ends thereof. However, the present invention also contemplates spring rings of other geometrical shapes such as elipse-shaped. Further, the spring rings may be subdivided into a number of segments, so that, for the spreading respectively pulling together, a number of pistons may be arranged between the spring ring portions of an individual spring ring.

The present invention also contemplates different arrangements of the ring grooves 7, such as, for example, on the outer side of the stanchion 4.

According to other non-illustrated embodiments of the invention, the locking device 11 is arranged inside of the housing or leg formed by the inner and outer sleeves 3 and 2, as in the embodiments shown. However the adjusting device 10 is housed outside of the leg.

The operation of the support leg apparatus of the present invention is as follows. When stanchion 4 of the support leg 1 is to be extended from a position shown in FIG. 1 into a support position, the piston 8 is pressurized at its front side by a pressure medium through a line 19.

The supply of medium to line 19 may be from spaces within the support leg. In the illustrated embodiment, the support leg is provided with an oil container 20 and a hydro-storer 21 in contact with respective opposite sides of pressure bladder 25.

Before the piston 8 is moved in the direction 22, the spring rings 14, 14*a* of the locking device 11 are loosened so that the spring rings 14, 14*a* become free from the ring grooves 7 of stanchion 4. Also, the spring rings 15, 15*a* of the adjusting device 10 are pressed into the adjacent ring grooves 7 of the stanchion 4 so as to lock the stanchion for movement along with the piston 8. Now, the piston 8 can move in the direction 22 and take the stanchion 4 along with it so that the stanchion 4 is pushed outwardly between the sleeves 2 and 3 (in the righthand direction as shown in FIG. 1 so as to effectively lengthen the support leg).

Stanchion 4 is held in respective extended positions by the spring rings 14, 14*a* of the locking device 11, which spring rings are spread apart and pressed into the ring grooves 7 of stanchion 4 in the manner described above.

After the locking device 11 locks the stanchion 4 in an extended position, the spring rings 15, 15*a* of the adjusting device 10 can be compressed by the piston-cylinder arrangement 18 and medium can be supplied through line 23 to push piston 8 in the direction of arrow 24 into the starting position shown in FIG. 1. The stanchion 4 can now, through the piston 8 and adjusting device 10 connected with the piston, again be moved further outwardly. That is, the stanchion 4 is lockable in each extended lengths in dependence on the stops in the stanchion. The respective extended or retracted length of the stanchion is determined by the axial distance or spacing of the ring grooves arranged in the stanchion.

The stanchion may, therefore, be supported by the pressure medium as well as by the mechanical locking means (the spring rings).

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

To aid in an understanding of this invention, reference is hereby made to two commonly assigned related applications to be filed on even date herewith, titled SWINGABLE SUPPORT LEG FOR A BRIDGE, based on German application P 22 932.1 and SUPPORT ELEMENT FOR A BRIDGE, based on German application P 24 22 892.0.

We claim:

1. Support leg apparatus for bridges and the like, especially for portable bridges; said apparatus comprising:

housing means, a stanchion disposed at said housing means for longitudinal movement with respect thereto, stanchion length adjusting means for forcibly moving said stanchion longitudinally with respect to said housing means, said adjusting means including a movable member and means for moving said movable member with respect to said housing means, first locking means for selectively locking said stanchion in respective adjusted positions with respect to said housing means, and second locking means for selectively locking said stanchion to said movable member, wherein each of said first and second locking means are fluidly controlled and include locking members movable into and out of engagement with detent stop means of said stanchion.

2. Apparatus according to claim 1, wherein said means for moving said movable member includes hydraulic pressure means, and wherein each of said first and second locking means are hydraulically controlled.

3. Apparatus according to claim 1, wherein said housing means includes an inner sleeve and an outer sleeve, said stanchion being movably guided between said inner and outer sleeve, wherein said movable member is a hydraulically operated piston guided in said inner sleeve, and wherein said second locking means is carried by and movable with said piston.

4. Apparatus according to claim 2, wherein said housing means includes an inner sleeve and an outer sleeve, said stanchion being movably guided between said inner and outer sleeve, wherein said movable member is a hydraulically operated piston guided in said inner sleeve, and wherein said second locking means is carried by and movable with said piston.

5. Apparatus according to claim 4, wherein said second locking means is located at the free end of said piston remote from the pressure faces thereof, and wherein said second locking means includes hydraulically controllable spring rings which are radially movable into and out of locking engagement with stop grooves formed on said stanchion and constituting said detent stop means.

6. Apparatus according to claim 4, wherein said first locking means is fixed in longitudinal position at the end of said inner sleeve which is open for permitting longitudinal extension of said stanchion, and wherein said first locking means includes hydraulically controllable spring means which are radially movable into and out of locking engagement with said stop grooves formed on said stanchion.

7. Apparatus according to claim 5, wherein said first locking means is fixed in longitudinal position at the end of said inner sleeve which is open for permitting longitudinal extension of said stanchion, and wherein said first locking means includes hydraulically controllable spring means which are radially movable into and out of locking engagement with said stop grooves formed on said stanchion.

8. Apparatus according to claim 4, wherein the stanchion is formed as a tube provided at the inner walls thereof with a plurality of ring grooves arranged longitudinally spaced from one another, said ring grooves constituting said detent stop means.

9. Apparatus according to claim 5, wherein the stanchion is formed as a tube provided at the inner walls thereof with a plurality of ring grooves arranged longitudinally spaced from one another, said ring grooves constituting said stop grooves.

10. Apparatus according to claim 6, wherein the stanchion is formed as a tube provided at the inner walls thereof with a plurality of ring grooves arranged longitudinally spaced from one another, said ring grooves constituting said stop grooves.

11. Apparatus according to claim 7, wherein the stanchion is formed as a tube provided at the inner walls thereof with a plurality of ring grooves arranged longitudinally spaced from one another, said ring grooves constituting said stop grooves.

12. Apparatus according to claim 5, wherein each of said spring rings is formed as a split ring, and wherein piston-cylinder means are connected to each of said split rings at opposite sides of the slot formed between the respective ends thereof.

13. Apparatus according to claim 6, wherein each of said spring rings is formed as a split ring, and wherein piston-cylinder means are connected to each of said split rings at opposite sides of the slot formed between the respective ends thereof.

14. Apparatus according to claim 11, wherein each of said spring rings is formed as a split ring, and wherein piston-cylinder means are connected to each of said split rings at opposite sides of the slot formed between the respective ends thereof.

15. Apparatus according to claim 3, wherein an oil container as well as an after-connected hydro-reservoir, as well as hydraulic control elements for supply of fluid medium to the piston and other aggregates are arranged inside said inner sleeve.

16. Apparatus according to claim 5, wherein an oil container as well as an after-connected hydro-reservoir, as well as hydraulic control elements for supply of fluid medium to the piston and other aggregates are arranged inside said inner sleeve.

17. Apparatus according to claim 7, wherein an oil container as well as an after-connected hydro-reservoir, as well as hydraulic control elements for supply of fluid medium to the piston and other aggregates are arranged inside said inner sleeve.

18. Apparatus according to claim 14, wherein an oil container as well as an after-connected hydro-reservoir, as well as hydraulic control elements for supply of fluid medium to the piston and other aggregates are arranged inside said inner sleeve.

* * * * *